US006036334A

United States Patent [19]

Nakano

[11] Patent Number: 6,036,334

[45] **Date of Patent: *Mar. 14, 2000**

[54] ILLUMINATING APPARATUS AND FRAME TO WHICH THE ILLUMINATING APPARATUS IS ATTACHED

[75] Inventor: Kazuo Nakano, Nagoya, Japan

[73] Assignee: Timely Elegance Co., Ltd., Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/589,336

[22] Filed: Jan. 22, 1996

[30] Foreign Application Priority Data

Nov. 17, 1995 [JP] Japan ..... 7-324043

[51] Int. Cl.[7] ..... F21V 33/00; F21V 9/16; A47G 1/06; G09F 13/00

[52] U.S. Cl. ..... 362/234; 362/84; 362/228; 362/240; 362/247; 362/812; 40/714; 40/715; 40/543; 40/559; 40/442; 40/444

[58] Field of Search ..... 362/84, 228, 229, 362/240, 247, 233, 231, 812, 811, 125, 806; 40/714, 715, 543, 559, 442, 443, 444

[56] References Cited

U.S. PATENT DOCUMENTS

| | | | |
|---|---|---|---|
| 947,127 | 1/1910 | Roberts . | |
| 1,348,957 | 8/1920 | Pope | 362/247 |
| 1,409,114 | 3/1922 | Loveberg | 362/247 |
| 1,739,320 | 12/1929 | Lloyd . | |
| 1,762,760 | 6/1930 | Chalkley, Jr. | 362/84 |
| 1,811,333 | 6/1931 | Rasmussen . | |
| 1,976,545 | 10/1934 | Doane | 362/231 |
| 1,998,573 | 4/1935 | Doane | 362/247 |
| 3,271,568 | 9/1966 | Lundberg | 362/812 |
| 3,430,039 | 2/1969 | Piccola | 362/228 |
| 3,723,720 | 3/1973 | Schmidt et al. . | |
| 3,786,245 | 1/1974 | Cincotta et al. . | |
| 3,871,609 | 3/1975 | Benjamin . | |
| 4,091,441 | 5/1978 | Ott | 362/1 |
| 4,196,460 | 4/1980 | Schreckendgust . | |
| 4,504,892 | 3/1985 | Zulfilar . | |
| 4,536,656 | 8/1985 | Sowa | 250/463.1 |
| 4,744,012 | 5/1988 | Bergkvist | 362/84 |
| 5,121,287 | 6/1992 | Lee | 361/331 |
| 5,165,783 | 11/1992 | Barron, Sr. | 362/253 |
| 5,396,406 | 3/1995 | Ketchpel | 362/27 |
| 5,426,879 | 6/1995 | Hecker | 40/427 |
| 5,548,494 | 8/1996 | Blackman | 362/183 |
| 5,585,967 | 12/1996 | Monroe | 359/629 |

FOREIGN PATENT DOCUMENTS

| | | |
|---|---|---|
| 849408 | of 0000 | France . |
| 2 529 065 | 12/1983 | France . |
| 39 17 101 | 11/1990 | Germany . |
| 88/01709 | 3/1988 | WIPO . |
| 88/06696 | 9/1988 | WIPO . |
| 0 646 749 | 4/1995 | WIPO . |

*Primary Examiner*—Ira S. Lazarus
*Assistant Examiner*—David Lee
*Attorney, Agent, or Firm*—Nikaido, Marmelstein, Murray & Oram LLP

[57] ABSTRACT

An illuminating apparatus is formed with an ultraviolet lamp and at least one incandescent lamps that repeat a predetermined illumination pattern in which the lamps are turned on, gradually brightened within a predetermined period, gradually dimmed out within a predetermined period subsequent to a period for the maximum illumination thereof, and then turned off, to light a picture, which is supported on a frame to which the illuminating apparatus is attached, to be recognized as nighttime and daytime views with natural changes therebetween.

16 Claims, 5 Drawing Sheets

ILLUMINATING APPARATUS AND FRAME TO WHICH THE ILLUMINATING APPARATUS IS ATTACHED

BACKGROUND OF THE INVENTION

1. Field of the Invention

This invention relates to an illuminating apparatus for lighting pictures, posters, and their duplications (hereinafter simply referred as to "pictures") and, more particularly, to an illuminating apparatus for lighting pictures on which a particular paint is applied to emit or reflect light upon the illumination of an ultraviolet lamp or a black light.

2. Description of Prior Art

Pictures in which a particular paint is used to emit or reflect predetermined light upon the illumination of an ultraviolet lamp or black light, have been created these days. When such a picture on which, for example, such a particular paint is applied to a part of a landscape (for example, the particular paint is coated in a crescent moon shape over a disc shaped portion for depicting the sun made of regular paint) is observed in the daytime of high illumination, the sun portion is observed as it is, and other portions of the landscape are seen as bright. In other words, the picture is seen as a daytime landscape. To the contrary, when the picture is observed in the nighttime of low illumination or in lighting a black light in a darkroom, the picture, including the sun portion, is not only observed as dark but also observed so that only the crescent moon portion is emitting. In other words, the picture is viewed as a nighttime landscape.

The inventor of this application had developed an illuminating apparatus constituted of an ultraviolet lamp to be normally turned on, incandescent lamps, and a switch for going on and off the incandescent lamps, to illuminate the pictures in use of such particular paint. According to the illuminating apparatus above, by turning on and off the incandescent lamps through control rendering the switch on and off, the pictures using the particular paint can arbitrarily be changed between the daytime view and the nighttime view.

The illuminating apparatus above, however, provides no more than reciprocal changes between daytime and nighttime views merely through operation of the switch, and such changes are extremely monotone.

SUMMARY OF THE INVENTION

It is an object of the invention to provide an illuminating apparatus capable of rendering a picture perceivable as a view corresponding to natural changes which tend to gradually vary and of presenting a feeling like real, in order to solve the problem raised by the conventional illuminating apparatus above.

The foregoing object is accomplished by an illuminating apparatus including an ultraviolet lamp and at least one incandescent lamp. The incandescent lamp repeats a predetermined illumination pattern in which the incandescent lamp is turned on, gradually brightened within a predetermined period, gradually dimmed out within a predetermined period subsequent to a period for the maximum illumination, and then turned off for a predetermined period.

According to an embodiment of the invention, the illuminating apparatus may include a controller connected to the incandescent lamp for controlling the incandescent lamp so as to repeat the predetermined illumination pattern. A receiver may be connected to the controller to receive signals indicative of turning on and off of the incandescent lamp and/or indicative of maintaining an illumination state of the incandescent lamp from a transmitter. The illuminating apparatus can constitute a part of a frame for supporting pictures.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
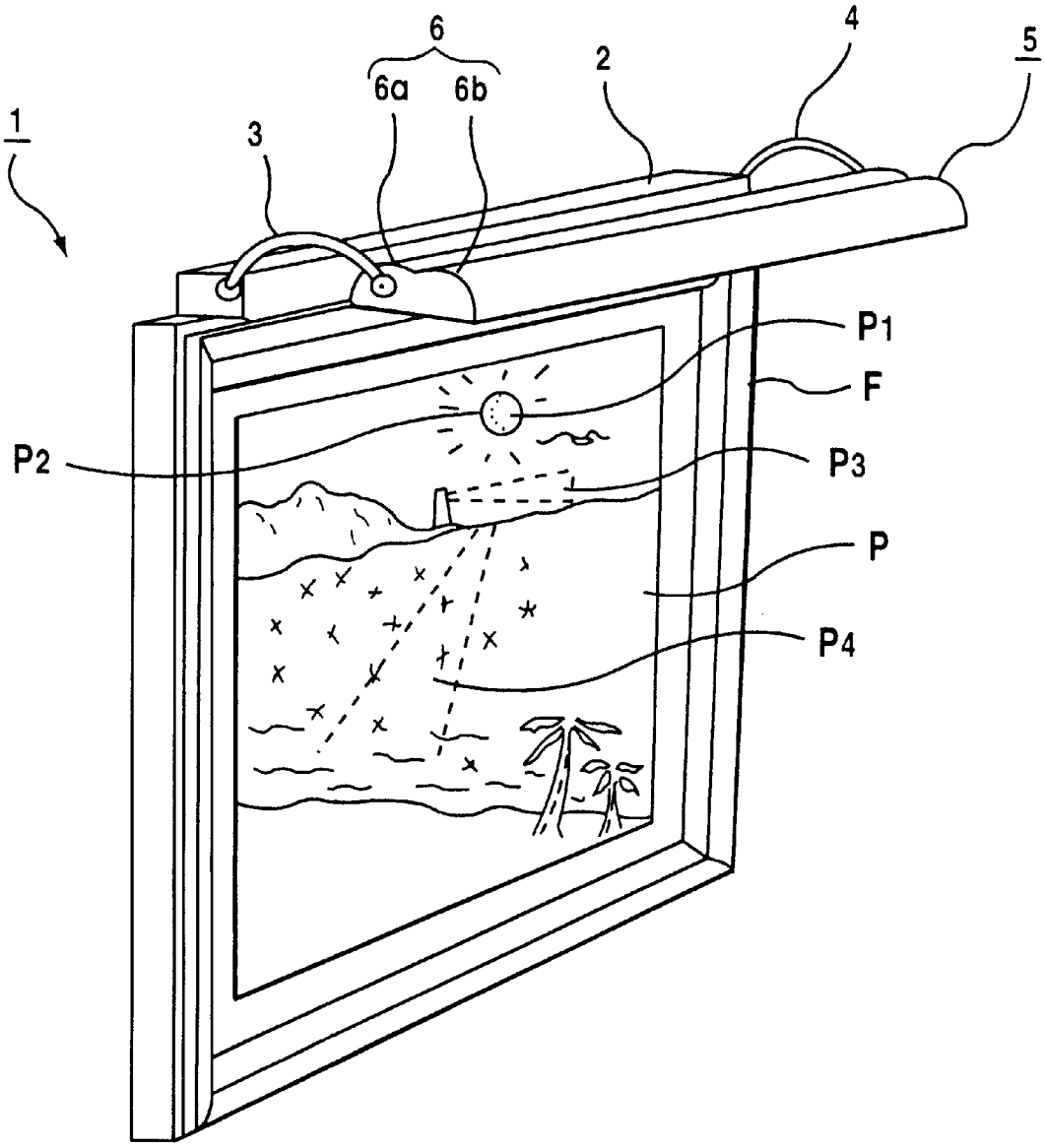
FIG. 1 is a perspective view showing an illuminating apparatus according to a preferred embodiment of the invention in a situation that the apparatus is attached to a frame and a picture when incandescent lamps are at the maximum illumination.

Referring to the drawings in detail, in particular, to FIG. 1, an illuminating apparatus 1 is shown. The illuminating apparatus 1 is as shown in FIG. 1 attached to a frame F supporting a picture P on which a particular paint is used to form the picture P. Specifically, the picture P is depicting a sea shore scenery; the sun, mountains, a lighthouse, the sea, palms are illustrated by regular paints that have been used conventionally; a figure P2 in a crescent moon shape is illustrated by the particular paint in a disc figure P1 indicating the sun to emit or reflect light upon illumination of an ultraviolet lamp as described below; a figure P3 indicating the light of the light house is illustrated by the same particular paint; a figure P4 indicating a portion that the moon light from the crescent moon is reflected on the surface of the sea is also illustrated by the same particular paint. In FIG. 1, the figures P2 to P4 painted by the particular paint are indicated by broken lines.

Figure 2:
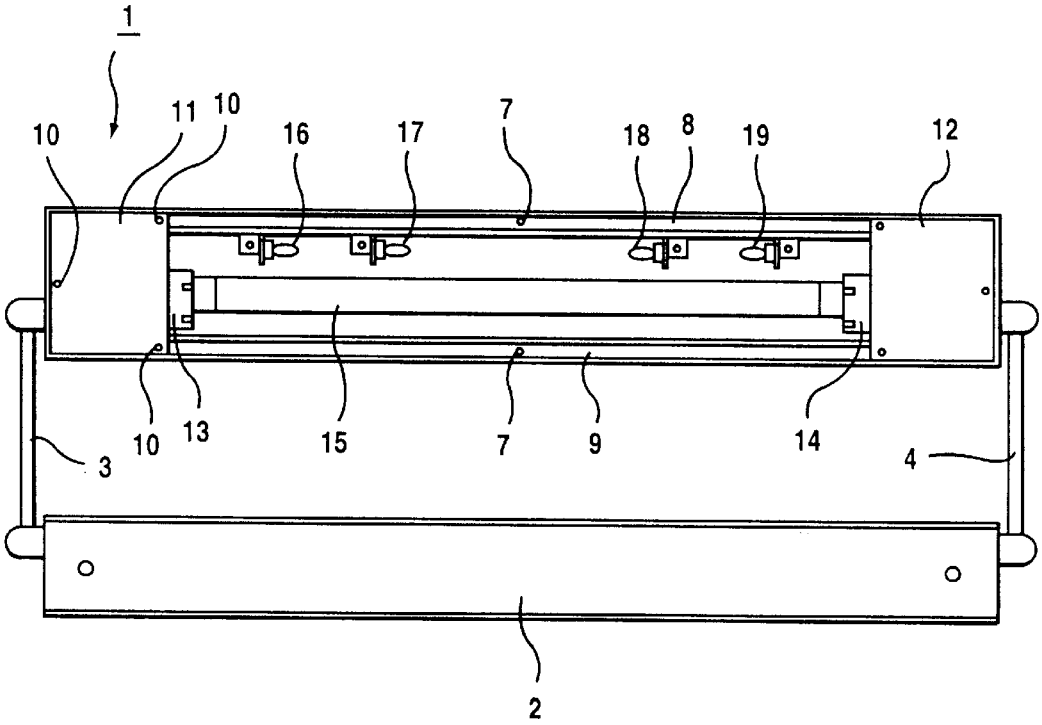
FIG. 2 is a bottom view showing the illuminating apparatus shown in FIG. 1.

The illuminating apparatus 1 attached to the frame F of the picture P thus depicted, is constituted of an apparatus body 2 secured on a top of the frame F, a first arm 3 whose proximal end is fixed to the left side of the apparatus body 2, a second arm 4 whose proximal end is fixed to the right side of the apparatus body 2, and a lighting section 5 pivotably supported by the distal ends of the first and second arms 3, 4. The apparatus body 2 is attached and secured to the frame F and incorporates a controller for turning on and off an ultraviolet lamp and incandescent lamps. The first and second arms 3, 4 are formed in an arc shape with a hollow, respectively, in which wires are provided to electrically connect the controller with the ultraviolet lamp and incandescent lamps constituting the lighting section 5 as described below. The lighting section 5, attached to the distal ends of the first and second arms 3, 4, includes, as shown in FIG. 1, a lampshade 6 formed with two arc portions 6*a*, 6*b*, as shown in FIG. 2, a narrow front fixing 8 secured to the front inner surface of the lampshade 6 by screws 7, and a rear fixing 9 secured in parallel with the front fixing 8 by the screws 7. Left and right lids 11, 12 are fixed to both sides of the bottom of the lampshade 6 through screws 10 between the front and rear fixings 8, 9. A pair of lamp holders 13, 14 formed with inside terminals not shown is arranged behind the left and right lids 11, 12. An ultraviolet lamp 15 serving as a black light is detachably attached between the lamp holders 13, 14. Four incandescent lamps 16 to 19, or four light bulbs, are attached and arranged in a line along the front fixing 8.

Figure 3:
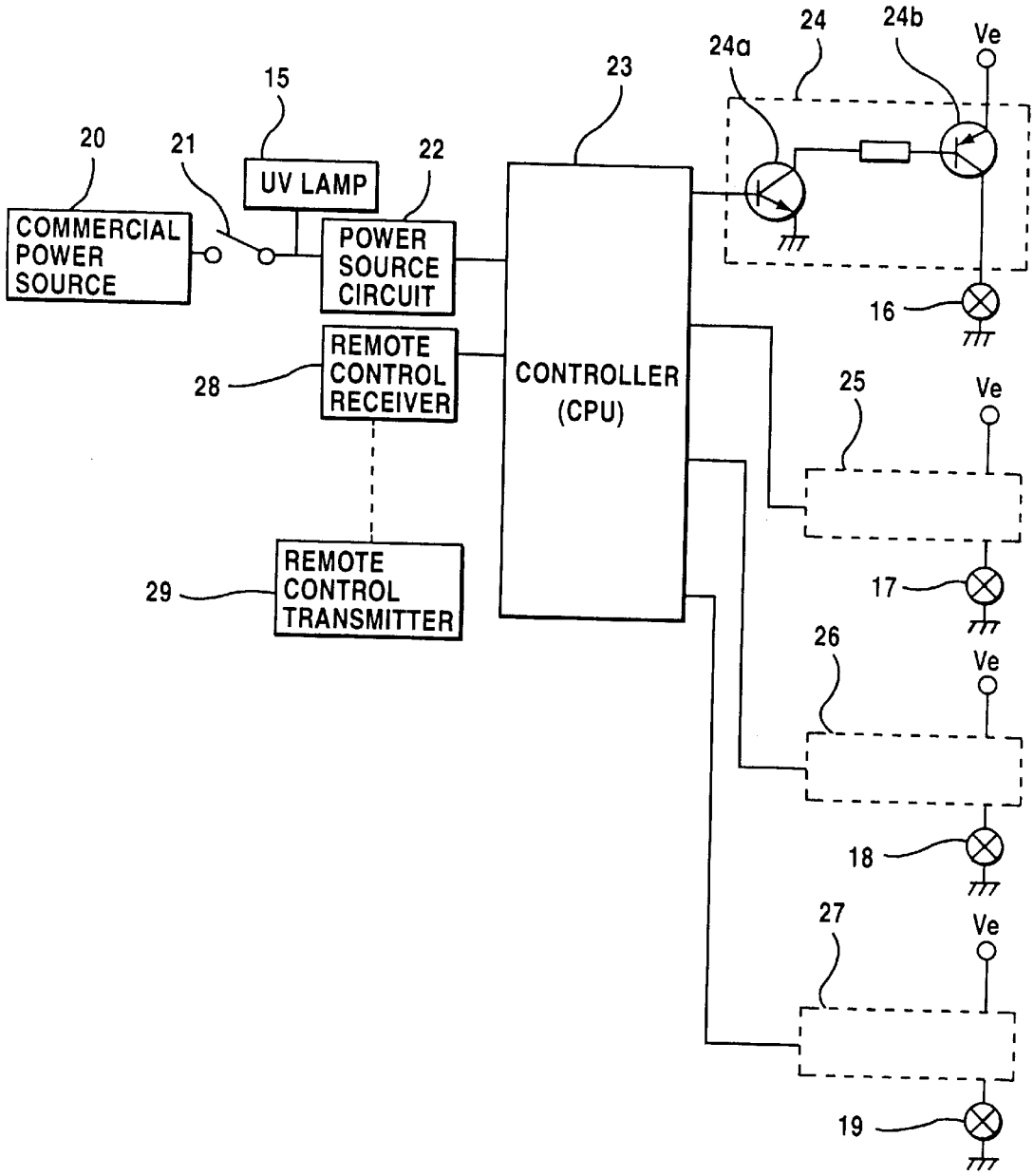
FIG. 3 is a block diagram illustrating a circuit for controlling the incandescent lamps.

Each of the incandescent lamps 16 to 19 is controlled by the corresponding circuit incorporated with the apparatus body 2. Now, referring to FIGS. 3, 4, circuitry of control of the ultraviolet lamp 15 and the incandescent lamps 16 to 19 is described. In this circuit, as shown in FIG. 3, a power source circuit 22 is connected to a commercial power source 20 through a main switch 21; the power source circuit 22 serves as the power supply for a controller (CPU) 23. The ultraviolet lamp 15 is also connected to the commercial power source 20 through the main switch 21. The controller 23 is connected to the four incandescent lamps 16 to 19 through four driver circuits 24 to 27, respectively. A remote control receiver 28 is connected to the controller 23 to set various controls from a remote control transmitter 29.

Figure 4:
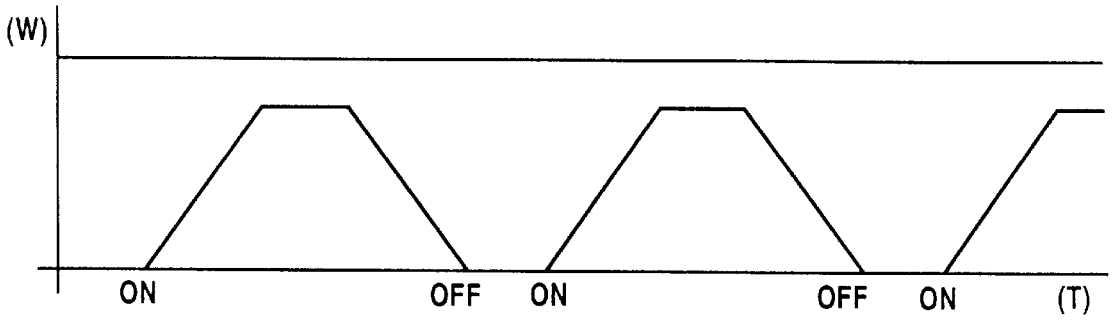
FIG. 4 is a diagram showing illumination against change of the incandescent lamps.

The incandescent lamps 16 to 19 are controlled to repeat their on and off states as shown in FIG. 4 by the controller 23 and the driver circuits 24 to 27. These driver circuits 24 to 27 have a known circuitry and are constituted of a pnp-type control transistor 24*a* and an npn-type drive transistor 24*b*, respectively; the incandescent lamps 16 to 19 are connected to the corresponding drive transistor 24*b*, respectively. The controller 23 is built with a memory not shown, which memorizes, for example, the incandescent lamps' illumination on the time basis as shown in FIG. 4. The remote controller transmitter 29 is formed with first and second switches not shown; the first switch is for turning on and off the incandescent lamps 16 to 19; the second switch is for stopping brightening and dimming the incandescent lamps 16 to 19 to hold the illumination of the lamps at that time and for resuming the brightening and dimming control.

Specifically, when a predetermined period (30 seconds) passes after the main switch 21 is turned on to activate the power source circuit 22, the respective incandescent lamps 16 to 19 are turned on, and then, the respective incandescent lamps 16 to 19 are gradually brightened within a predetermined period (45 seconds) to reach the peak, or the maximum illumination. When a predetermined period (15 seconds) passes after the illumination reaches the maximum value, the respective incandescent lamps 16 to 19 are gradually dimmed out within a predetermined period (45 seconds) until reaching the off-state of the lamps. The lamps are then turned on again after a predetermined period (30 seconds) passes. The incandescent lamps 16 to 19 repeat this illumination pattern. Accordingly, upon turning on the main switch 21, the ultraviolet lamp 15 is turned on, and the controller 23 is activated through the power source circuit 22, thereby operating the respective incandescent lamps 16 to 19 to be turned on and off repetitively according to the illumination pattern memorized in the memory of the controller 23 and shown in FIG. 4. That is, in the controller 23, the illumination intensity value is read out from the memory in conjunction with elapse time, and the base current of the control transistor 24*a* is controlled by signals from a D/A converter (not shown) formed in the controller 23, thereby changing the current flowing from the emitter to the collector of the drive transistor 24*b*, and thereby controlling the current value (illumination intensity) flowing through the respective incandescent lamps 16 to 19. If the incandescent lamps 16 to 19 are wanted to be turned off during this illumination control, the first switch formed at the remote control transmitter 29 is controlled to turn off the incandescent lamps 16 to 19 and to keep only the ultraviolet lamp 15 going on. To hold the illumination of the respective incandescent lamps 16 to 19, the second switch is controlled to maintain the illumination at that time.

Figure 6:
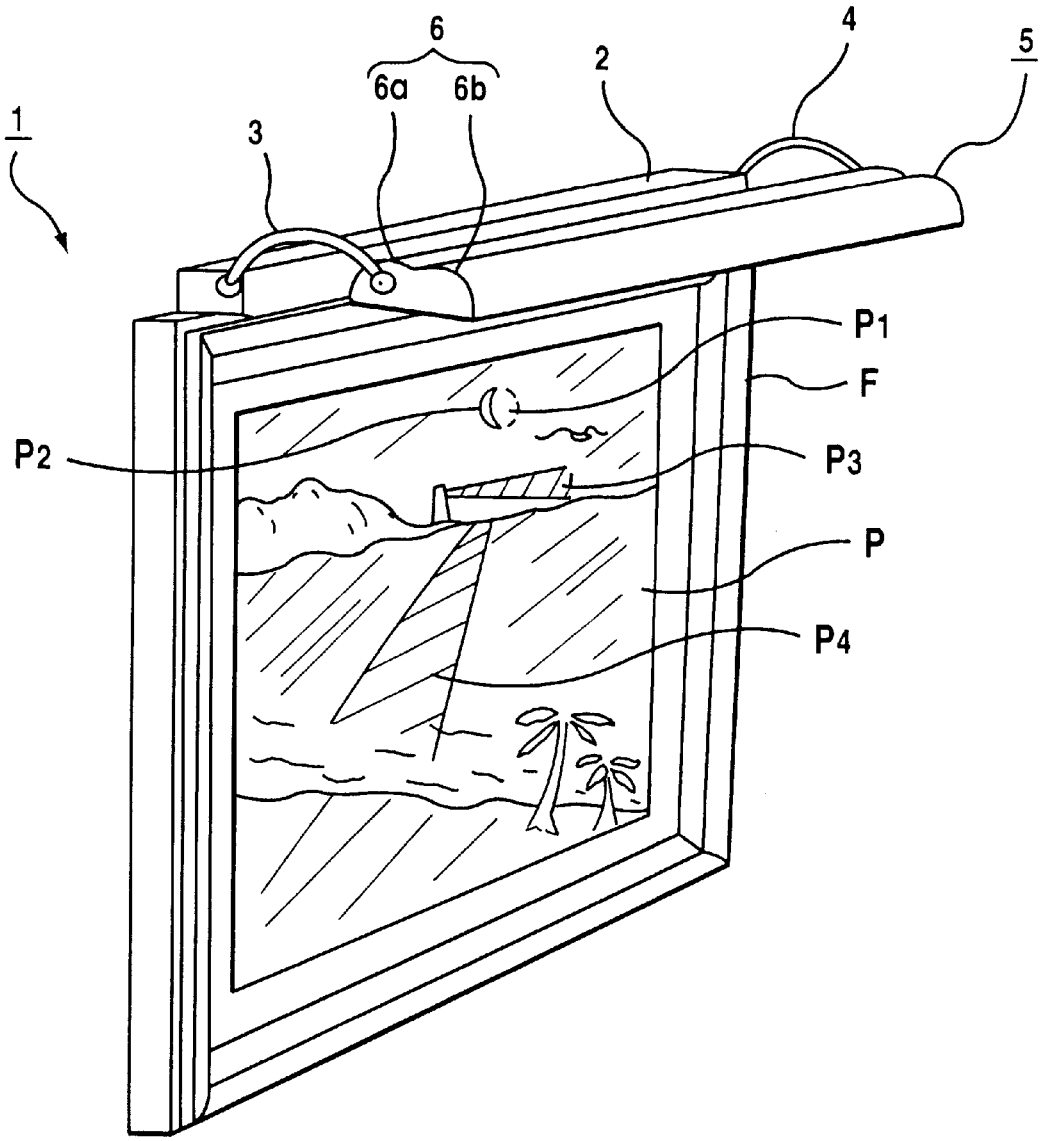
FIG. 6 is a perspective view showing the illuminating apparatus shown in FIG. 1 and the picture when the illumination of the incandescent lamps is zero.

According to the illuminating apparatus 1 formed with the respective incandescent lamps 16 to 19 whose illumination thus changes in accordance with the predetermined illumination pattern and formed with the ultraviolet lamp 15 normally turned-on, as described above, upon turning on of the main switch 21, only the ultraviolet lamp 15 is turned on at the beginning, and the respective incandescent lamps 16 to 19 are turned off, so that as shown in FIG. 6 the entire picture P is seen as extremely dark and that the figure P2 in the crescent moon shape, the figure P3 indicating the light of the lighthouse, and the figure P4 as the portion that the moon light is reflected on the sea level, at which the particular paint is applied to emit or reflect light in response to the light from the ultraviolet lamp 15, are recognized as brighter portions than portions painted with any regular paint. Accordingly, the entire picture P is recognized as a nighttime view. Then, when the predetermined time passes, the respective incandescent lamps 16 to 19 are turned on as shown in FIG. 4 and brightened gradually. The incandescent lamps 16 to 19 thus brightened make the illumination on the entire picture P bright gradually, and consequently, the figures P2 to P4 painted by the particular paint become gradually unrecognizable. Finally, when the illumination from the incandescent lamps 16 to 19 becomes the maximum, the respective figures P2 to P4 becomes unrecognizable at all. That is, the entire picture P is recognized as a daytime view as shown in FIG. 1.

According to the illuminating apparatus 1 above, where used for lighting the picture P painted with the particular paint that emits or reflects light upon illumination of the ultraviolet lamp 15, the illuminating apparatus 1 is capable of changing the scenery of the picture P to the nighttime scenery, the morning time scenery, the daytime scenery, the evening time scenery, and the nighttime scenery, sequentially and gradually (as corresponding to natural changes on the time basis), thereby giving observers a feeling as if real as well as great relaxation. In particular, where the picture P is watched using the illuminating apparatus 1 above while listening to music in use of a headphone or the like, the illuminating apparatus 1 gives greater relaxation to the observers.

Figure 5:
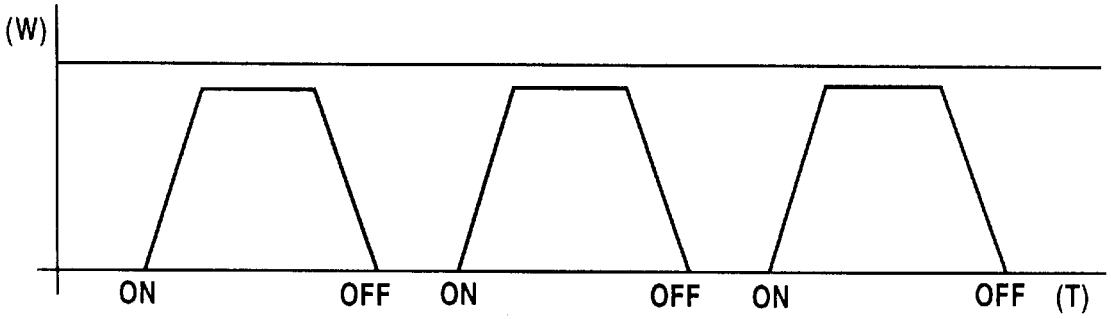
FIG. 5 is a diagram showing another illumination pattern different from the pattern shown in FIG. 4.

It is to be noted that although in this embodiment the ultraviolet lamp and the incandescent lamps are formed at the lighting section 5 pivotably supported to the distal ends of the first and second arms 3, 4, the ultraviolet lamp and the incandescent lamps are not necessarily provided at the lighting section 5, and for example, the ultraviolet lamps may be arranged on left and right sides of the frame to which the picture is attached while the incandescent lamps are arranged on upper and lower sides of the frame. Although in this embodiment the illuminating apparatus 1 includes four incandescent lamps attached thereto, the incandescent lamps are not limited to a set of four pieces and can be either single or plural. The illumination pattern according to which the incandescent lamps are controlled is not limited to the pattern shown in FIG. 4 and can be, for example, a pattern that the period between the time that the lamps are turned on and the time that the lamps reach the maximum illumination is longer than one shown in FIG. 4 or a pattern that such a period is shorter as shown in FIG. 5.

As apparent from the above description for the illuminating apparatus 1, according to this invention, the illuminating apparatus 1 is constituted so that the incandescent lamps repeat the predetermined illumination pattern in which the lamps are brightened and dimmed out as time elapses, so that the observers can recognize the scenery in the picture with a feeling very like real and thereby receive great relaxation.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not to be limited by the specification, but be defined by the claims set forth below.

What is claimed is:

1. An illuminating apparatus comprising:

an ultraviolet lamp;

a plurality of incandescent lamps connected to repeat a predetermined illumination pattern in which said incandescent lamps are turned on, gradually brightened within a predetermined period, gradually dimmed out within a predetermined period subsequent to a period for the maximum illumination thereof, and then turned off for a predetermined period; and means for mounting said illuminating apparatus on a top side of a frame containing a picture having selected portions illustrated by a paint which emits or reflects light upon illumination by ultraviolet light so as to illuminate a front side of said picture.

2. The illuminating apparatus according to claim 1, further comprising a contrtoller connected to said incandescent lamps for controlling the lamps so as to repeat the predetermined illumination pattern.

3. The illuminating apparatus according to claim 2, further comprising a receiver connected to the controller, and a transmitter for feeding signals indicative of turning on and off of said incandescent lamps and/or indicative of maintaining an illumination state of said incandescent lamps to the receiver.

4. The illuminating apparatus according to claim 1, wherein said ultraviolet lamp is connected to be continually on during the entire predetermined illumination pattern.

5. A frame comprising:

a member having a top side and a bottom side to which a picture having a front side, selected portions on said front side illustrated by a paint which emits or reflects light upon illumination by ultraviolet light, and a back side is attached; and an illuminating apparatus attached to a top side of said member so that said front side of said picture is illuminated, said illuminating apparatus comprising:

an ultraviolet lamp;

a plurality of incandescent lamps connected to repeat a predetermined illumination pattern in which the incandescent lamps are turned on, gradually brightened within a predetermined period, gradually dimmed out within a predetermined period subsequent to a period for the maximum illumination thereof, and then turned off for a predetermined period.

6. The frame according to claim 5, wherein said ultraviolet lamp is connected to be continually on during the entire predetermined illumination pattern.

7. An illumination device for lighting a picture having a front side, selected portions on said front side illustrated by a paint which emits or reflects light upon illumination by ultraviolet light, and a back side comprising:

a frame into which said picture can be mounted;

an illuminating apparatus attached to a top portion of said frame;

a plurality of incandescent lamps disposed on said illuminating apparatus wherein said front side of said picture is illuminated by said lamps, and wherein said lamps are connect to be periodically gradually brightened and then gradually dimmed to simulate a change in lighting from nighttime until daytime;

an ultraviolet lamp disposed on said illuminating apparatus, wherein said ultraviolet lamp emits light which has a spectral range which is centered in the ultraviolet and wherein said ultraviolet lamp illuminates said front side of said picture.

8. The illumination device according to claim 7, wherein said ultraviolet lamp is connected to continually illuminate said front side of said picture.

9. An illuminating apparatus for a non-translucent picture in a frame comprising:

an ultraviolet lamp;

a plurality of incandescent lamps connected to repeat a predetermined illumination pattern in which said incandescent lamps are turned on, gradually brightened within a predetermined period, gradually dimmed out within a predetermined period subsequent to a period for the maximum illumination thereof, and then turned off for a predetermined period; and means for mounting said illuminating apparatus on a top side of the frame containing the picture so as to illuminate a front side of the picture.

10. The illuminating apparatus according to claim 9, further comprising a controller connected to said incandescent lamps for controlling the lamps so as to repeat the predetermined illumination pattern.

11. The illuminating apparatus according to claim 10, further comprising a receiver connected to the controller, and a transmitter for feeding signals indicative of turning on and off of said incandescent lamps and/or indicative of maintaining an illumination state of said incandescent lamps to the receiver.

12. The illuminating apparatus according to claim 9, wherein said ultraviolet lamp is connected to be continually on during the entire predetermined illumination pattern.

13. A frame and a non-translucent picture comprising:

a member having a top side and a bottom side to which the picture having a front side and a back side is attached; and an illuminating apparatus attached to a top side of said member so that said front side of said picture is illuminated, said illuminating apparatus comprising:

an ultraviolet lamp;

a plurality of incandescent lamps connected to repeat a predetermined illumination pattern in which the incandescent lamps are turned on, gradually brightened within a predetermined period, gradually dimmed out within a predetermined period subsequent to a period for the maximum illumination thereof, and then turned off for a predetermined period.

14. The frame according to claim 13, wherein said ultraviolet lamp is connected to be continually on during the entire predetermined illumination pattern.

15. An illumination device for lighting a non-translucent picture having a front side and back side comprising:

a frame into which said picture can be mounted;

an illuminating apparatus attached to a top portion of said frame;

a plurality of incandescent lamps disposed on said illuminating apparatus wherein said front side of said picture is illuminated by said lamps, and wherein said lamps are connected to be periodically gradually brightened and then gradually dimmed to simulate a change in lighting from nighttime until daytime;

an ultraviolet lamp disposed on said illuminating apparatus, wherein said ultraviolet lamp emits light which has a spectral range which is centered in the ultraviolet and wherein said ultraviolet lamp illuminates said front side of said picture.

16. The illumination device according to claim 15, wherein said ultraviolet lamp is connected to be continually on to illuminate said front side of said picture.

* * * * *